US010054288B2

(12) United States Patent
Dyson et al.

(10) Patent No.: US 10,054,288 B2
(45) Date of Patent: Aug. 21, 2018

(54) LIGHTING DEVICE

(71) Applicant: Dyson Technology Limited, Wiltshire (GB)

(72) Inventors: Jacob Dyson, London (GB); Paul Dominic Whittaker, Bristol (GB); William John Darvill, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 133 days.

(21) Appl. No.: 15/366,585

(22) Filed: Dec. 1, 2016

(65) Prior Publication Data

US 2017/0159907 A1 Jun. 8, 2017

(30) Foreign Application Priority Data

Dec. 4, 2015 (GB) ..... 1521437.2

(51) Int. Cl.
*F21S 8/06* (2006.01)
*F21V 7/00* (2006.01)
(Continued)

(52) U.S. Cl.
CPC ..... *F21V 7/0016* (2013.01); *F21S 8/04* (2013.01); *F21S 8/06* (2013.01); *F21V 7/0025* (2013.01);
(Continued)

(58) Field of Classification Search
CPC ..... F21V 11/186; F21V 7/0016; F21V 11/18; F21V 11/183; F21S 8/04; F21S 6/008
See application file for complete search history.

(56) References Cited

U.S. PATENT DOCUMENTS 4,233,651 A 11/1980 Fabbri
4,257,086 A * 3/1981 Gulliksen ..... F21V 5/00 362/279
(Continued)

FOREIGN PATENT DOCUMENTS

BE 1014501 11/2003
CH 342540 5/1960
(Continued)

OTHER PUBLICATIONS

Search Report dated Dec. 16, 2015, directed to GB Application No. 1521437.2; 1 page.
(Continued)

*Primary Examiner* — Sean Gramling
(74) *Attorney, Agent, or Firm* — Morrison & Foerster LLP

(57) ABSTRACT

A lighting device includes a baffle extending about an optical axis to surround a light source, and a reflector module connected to the baffle. The reflector module includes a main reflector having a light exit opening from which a light output of the lighting device is projected towards a target area, the optical axis passing through the opening, and reflective surfaces adjacent to the opening for reflecting light incident thereon away from the opening. The reflector module further includes auxiliary reflectors for adjusting the shape of the light output of the lighting device. Each auxiliary reflector has a reflective surface, and is moveable relative to the main reflector between a stowed position and a deployed position in which at least part of the reflective surface of the auxiliary reflector is exposed, by the opening of the main reflector, to reflect light incident thereon away from the target area.

25 Claims, 19 Drawing Sheets

(51) Int. Cl.

| | |
|---|---|
| ***F21V 7/16*** | (2006.01) |
| ***F21V 7/18*** | (2006.01) |
| ***F21V 14/04*** | (2006.01) |
| ***F21V 11/18*** | (2006.01) |
| ***F21V 29/71*** | (2015.01) |
| ***F21V 29/76*** | (2015.01) |
| ***F21S 8/04*** | (2006.01) |

(52) U.S. Cl.

CPC ..... *F21V 7/0033* (2013.01); *F21V 7/16* (2013.01); *F21V 7/18* (2013.01); *F21V 11/18* (2013.01); *F21V 11/183* (2013.01); *F21V 11/186* (2013.01); *F21V 14/04* (2013.01); *F21V 29/71* (2015.01); *F21V 29/763* (2015.01)

(56) References Cited

U.S. PATENT DOCUMENTS

| | | | | |
|---|---|---|---|---|
| 4,322,779 | A | 3/1982 | Böhme et al. | |
| 5,582,479 | A * | 12/1996 | Thomas | F21S 8/04 362/263 |
| 6,102,554 | A | 8/2000 | Wynne Willson et al. | |
| 6,273,590 | B1 * | 8/2001 | Splane, Jr. | F21S 8/04 362/281 |
| 7,568,818 | B2 * | 8/2009 | Pfund | F21S 8/033 362/303 |
| 7,832,907 | B2 * | 11/2010 | Kotovsky | F21S 6/007 362/283 |
| 2001/0012205 | A1 | 8/2001 | Lassovsky | |
| 2005/0219849 | A1 | 10/2005 | Kotovsky et al. | |
| 2006/0232960 | A1 | 10/2006 | Pfund | |
| 2007/0285921 | A1 | 12/2007 | Zulim et al. | |
| 2008/0158879 | A1 | 7/2008 | Sun et al. | |
| 2012/0140477 | A1 | 6/2012 | Chang | |
| 2013/0038736 | A1 | 2/2013 | Yamamura | |
| 2014/0016322 | A1 | 1/2014 | Lu | |
| 2015/0085482 | A1 | 3/2015 | Murdoch | |

FOREIGN PATENT DOCUMENTS

| | | |
|---|---|---|
| CN | 103836392 | 6/2014 |
| DE | 101 61 468 | 7/2003 |
| DE | 20 2014 100 656 | 6/2015 |
| EP | 0 011 772 | 6/1980 |
| EP | 0 648 972 | 4/1995 |
| GB | 383145 | 11/1932 |
| GB | 1 284 855 | 8/1972 |
| GB | 1 397 981 | 6/1975 |
| GB | 2524093 | 9/2015 |
| JP | 2010-146973 | 7/2010 |
| KR | 10-2010-0096576 | 9/2010 |
| KR | 20-0475866 | 1/2015 |
| WO | WO-2011/132110 | 10/2011 |
| WO | WO-2013/143514 | 10/2013 |
| WO | WO-2015/136241 | 9/2015 |

OTHER PUBLICATIONS

International Search Report and Written Opinion dated Feb. 10, 2017, directed to International Application No. PCT/GB2016/053567; 12 pages.

* cited by examiner

B-B

LIGHTING DEVICE

REFERENCE TO RELATED APPLICATIONS

This application claims the priority of United Kingdom Application No. 1521437.2, filed Dec. 4, 2015, the entire contents of which are incorporated herein by reference.

FIELD OF THE INVENTION

The present invention relates to a lighting device. In its preferred embodiment, the lighting device is a suspended, or ceiling-mounted, lighting device.

BACKGROUND OF THE INVENTION

WO 2015/136241 describes a lighting device in which a LED light source generates a beam of light which is projected into a room or other interior environment. The light source is connected to a support frame, which is in thermal communication with a cooling circuit for dissipating heat generated by the light source during use of the device. The device is suspended from the ceiling of the room by suspension cables, which also comprise wires for providing an electrical current for driving the light source. A baffle surrounds the light source to direct the light generated by the light source towards a target area, and to reduce glare when a user views the device, when in operation, from the side.

SUMMARY OF THE INVENTION

The present invention provides a lighting device comprising a light source disposed on an optical axis; a baffle extending about the optical axis and surrounding the light source; and a reflector module connected to the baffle, the reflector module comprising a main reflector having a light exit opening from which a light output of the lighting device is projected towards a target area, the optical axis passing through the opening, and a plurality of reflective surfaces adjacent to the opening for reflecting light incident thereon away from the opening and at an angle to the optical axis; and a plurality of auxiliary reflectors for adjusting the shape of the light output of the lighting device, each auxiliary reflector comprising a reflective surface, each auxiliary reflector being moveable relative to the main reflector between a stowed position and a deployed position in which at least part of the reflective surface of the auxiliary reflector is exposed, by the opening of the main reflector, to reflect light incident thereon away from the opening.

The light source is preferably an LED array, such as a chip-on-board (COB) LED module, but the light source may comprise a plurality of such arrays, single or multiple LEDs, OLEDs or OLED arrays, or single or multiple laser diodes or a laser diode array. A lens may be provided for creating a selected light distribution pattern from the light generated by the light source. The baffle surrounds the light source, and optionally also the lens, to shield the light source from a normal field of view of the lighting device. In a preferred embodiment, in which the lighting device is in the form of a ceiling-mounted downlight device, the lens is selected to illuminate a generally rectangular target area located beneath the device, such as a meeting table or a floor space. The baffle preferably has the shape of a truncated rectangular pyramid, having first open end proximate to the light source, a second, generally rectangular open end remote from the light source, and a series of annular ridges between the open ends. The internal surfaces of the baffle may be reflective.

The invention improves on the device described in WO 2015/136241 through the provision of a reflector module. The first open end of the baffle is preferably connected to a support structure for supporting the light source. The reflector module is preferably connected to the second open end of the baffle, and is preferably disposed such that reflective surfaces of the reflector module are spaced from the baffle. The reflector module is thus connected to the baffle so that, when the lighting device is in the form of a ceiling-mounted downlight device, the reflector module is located beneath both the light source and the baffle. The reflector module may be detachably connected to the baffle to facilitate cleaning and adjustment of the aperture size of the reflector module.

The reflector module comprises a main reflector and a plurality of auxiliary reflectors. The main reflector comprises a light exit opening from which the light output of the lighting device is projected towards the target area. The light exit opening is thus spaced along the optical axis from, and preferably concentric with, the second open end of the baffle. The distance between the baffle and the reflector module is preferably fixed, and so the size of the light exit opening of the main reflector determines the maximum size of the target area which is illuminated by the device.

The reflector module comprises reflective surfaces adjacent to the opening. These reflective surfaces preferably define the periphery of the opening, and so preferably surround the opening. These reflective surfaces are arranged to reflect light incident thereon from the light source away from the opening and at an angle to the optical axis, and so towards, for example, a secondary target area, such as a ceiling upon which the device is mounted, for indirect, or secondary, illumination of the local environment of the device. These reflective surfaces are preferably arranged in a non-coplanar, non-parallel arrangement, and preferably such that each reflective surface faces away from the optical axis to ensure that any reflected light is not incident upon, and so not absorbed by, other components of the lighting device, but is instead incident on the secondary target area. Each reflective surface of the main reflector may take any shape for creating a desired illumination pattern on the secondary target area, and so may be a curved, a faceted or a planar reflective surface, or may comprise a combination of different shapes. In the preferred embodiment, each reflective surface of the main reflector is a planar reflective surface.

The main reflector preferably comprises a plurality of peripheral surfaces or walls arranged about, and angled relative to, the reflective surfaces adjacent to the opening. The peripheral surfaces can serve to shield the reflective surfaces of the reflector module from a normal field of view of the lighting device. Each of the peripheral surfaces preferably faces towards the optical axis, and may comprise one or more reflective surfaces for directing light, reflected thereon by one of the other reflective surfaces of the reflector module, towards the secondary target area.

The reflector module further comprises a plurality of moveable auxiliary reflectors for adjusting the shape of the light output of the lighting device. As an auxiliary reflector moves away from its stowed position, it moves across the light exit opening of the main reflector, either from one side of the opening (as viewed along the optical axis) or from the other, to reduce the aperture area of the reflector module, and thereby reduce the size of, or crop, the light output projected towards the target area. Simultaneously with the reduction of the aperture area of the reflector module, the amount of light which is reflected away from the opening, or target area, increases, through the exposure of the reflective surface of the auxiliary reflector to the generated light. In other words, the cropped light is not absorbed by the device, but is instead also reflected towards the secondary target area where it can contribute to the overall illumination of the environment in which the device is located.

Each auxiliary reflector comprises at least one reflective surface. These reflective surfaces are also preferably arranged to reflect light away from the opening, or target area, and at an angle to the optical axis. These reflective surfaces are preferably arranged in a non-coplanar, non-parallel arrangement, and preferably such that each reflective surface faces away from the optical axis to ensure that any reflected light is not incident upon, and so not absorbed by, other components of the lighting device. Each reflective surface of an auxiliary reflector may take any shape for creating a desired illumination pattern on the secondary target area, and so may be a curved, a faceted or a planar reflective surface, or may comprise a combination of different shapes. In the preferred embodiment, the reflective surfaces of the auxiliary reflectors are planar reflective surfaces.

The exposed reflective surface of the auxiliary reflector is preferably substantially parallel to an adjoining reflective surface of the main reflector. As mentioned above, the reflective surfaces of the main reflector are preferably planar surfaces and so the reflective surfaces of the auxiliary reflectors are preferably also planar surfaces, but in general the shapes of the reflective surfaces of the auxiliary reflectors preferably conform to the shapes of the adjoining reflective surfaces of the main reflector. The movement of the auxiliary reflector to its deployed position gradually increases the size and/or intensity of the illumination pattern generated on the secondary target area.

The reflector module may comprise any number of auxiliary reflectors, although for practical reasons any number between two and eight is preferred. The selected number is generally determined by the shape of the light exit opening of the main reflector, which in turn is determined by the shape of the target area. The opening may have a periphery which is in the shape of a closed curve, such as a circle, truncated circle, squircle or ellipse, or a closed polygon, which may be regular or irregular. For example, where the opening is hexagonal the reflector module may comprise six auxiliary reflectors. As another example, where the target area is rectangular the reflector module may comprise four auxiliary reflectors. In the preferred embodiment, the light exit opening of the main reflector comprises two relatively long, substantially parallel peripheral edges, and two relatively short non-parallel peripheral edges. The shape of the leading edge of each auxiliary reflector preferably matches that of the adjacent peripheral edge of the light exit opening.

One or more of the auxiliary reflectors may be flexible, hinged, or otherwise moveable or deformable. Preferably, the auxiliary reflectors are rigid structural members and so maintain the same shape as they move between their stowed and deployed positions.

Each auxiliary reflector may be moved in one of a number different ways relative to the main reflector. For example, each auxiliary reflector may be translatable, rotatable or pivotable relative to the main reflector. In a preferred embodiment, each auxiliary reflector is slidable relative to the main reflector. The auxiliary reflectors may be moveable manually relative to the main reflector, but alternatively a motorized system may be provided for moving the auxiliary reflectors relative to the main reflector, for example in response to a command signal received from a remote control. The auxiliary reflectors may be moveable individually relative to the main reflector. Alternatively, one or more pairs or groups of auxiliary reflectors may be moveable simultaneously relative to the main reflector.

The auxiliary reflectors are preferably disposed beneath the main reflector, and so when in its stowed position each auxiliary reflector is preferably shielded by the main reflector from the light generated by the light source. Each auxiliary reflector is preferably moveable relative to the main reflector from the stowed position to one of a plurality of deployed positions, in each of which the reflective surface of the auxiliary member is exposed by a respective different amount to the light generated by the light source. For example, each auxiliary reflector may comprise a detent member, and the main reflector may comprise a series of detent recesses or notches each for engaging with the detent member at a respective one of the deployed positions to check the motion of the auxiliary reflector relative to the main reflector. A catch or locking mechanism may be provided for securing the auxiliary reflector in a desired position.

Each auxiliary reflector is moveable relative to the main reflector along a predetermined path. The path may be curved or non-linear, but in a preferred embodiment each auxiliary reflector is moveable relative to the main reflector along a respective substantially linear path. Each of these paths is preferably angled relative to the optical axis.

The reflector module preferably comprises a pair of first auxiliary reflectors and a pair of second auxiliary reflectors, the first auxiliary reflectors and the second auxiliary reflectors being disposed alternately about the optical axis. The first auxiliary reflectors are disposed on first opposite sides of the opening, and so approach one another as they are moved towards their deployed positions, whereas the second auxiliary reflectors are disposed on second opposite sides of the opening, and so also approach one another as they are moved towards their deployed positions.

The first auxiliary reflectors preferably have a shape which is different from that of the second auxiliary reflectors. In the preferred embodiment each of the first auxiliary reflectors comprises a single planar reflective surface, which preferably extends along the length of one side of the opening. In its stowed position, each of the first auxiliary reflectors preferably lies directly beneath, and parallel to, a respective one of the reflective surfaces of the main reflector. As those reflective surfaces of the main reflector are non-coplanar, the reflective surfaces of the first auxiliary reflectors are preferably also non-coplanar. The reflective surface of each of the first auxiliary reflectors is preferably inclined relative to a plane which is normal to the optical axis of the opening, preferably at an angle in the range from 5 to 30°. These first auxiliary reflectors preferably have substantially parallel leading edges.

In contrast, each of the second auxiliary reflectors preferably comprises a plurality of non-coplanar reflective surfaces. These second auxiliary reflectors preferably have non-parallel leading edges. The reflective surfaces of each of the second auxiliary reflectors are preferably inclined relative to a plane which is normal to the optical axis of the opening, and more preferably are each parallel to a reflective surface of an adjacent first auxiliary reflector. This can allow at least a portion of each of the second auxiliary reflectors to be disposed between the main reflector and one of the first auxiliary reflectors when the auxiliary reflectors are in their deployed positions, and so allow the reflector module to have a compact shape. For example, a first portion of each of the second auxiliary reflectors may be disposed between the main reflector and a first one of the first auxiliary reflectors, and a second portion of each of the second auxiliary reflectors may be disposed between the main reflector and a second one of the first auxiliary reflectors.

Preferably, each of the first auxiliary reflectors is moveable relative to the main reflector in a direction which intersects the optical axis at a first angle, and each of the second auxiliary reflectors is moveable relative to the main reflector in a direction which intersects the optical axis at a second angle. The first angle is preferably different from the second angle. In the preferred embodiment, the second angle is 90°. The first angle may be greater or smaller than the second angle, and in the preferred embodiment is—as measured relative to a direction extending along the optical axis and away from the light source—an obtuse angle. The first angle is preferably in the range from 95 to 120°, and in the preferred embodiment is 105°.

As mentioned above, the reflective surfaces of the reflector module are arranged to reflect light away from the opening of the main reflector. Rather than allowing this reflected light to be incident directly upon a secondary target area, this reflected light may be further reflected by additional reflective surfaces of the reflector module towards a chosen target area. This chosen target area may be coincident with the target area, or may be a different, secondary target area. These additional reflective surfaces may be connected to the main reflector or to the auxiliary reflectors. The additional reflective surfaces may be moveable relative to the main reflector. The additional reflective surfaces may be moveable with the auxiliary reflectors. The additional reflective surfaces may be moveable relative to the auxiliary reflectors.

Each reflective surface of the reflector module may be either a specular reflective surface or a Lambertian reflective surface. The reflector module may therefore comprise specular reflective surfaces, Lambertian reflective surfaces, or a mixture of the two. A diffuser or a layer of diffusing material may be disposed over each reflective surface, or selected ones of the reflective surfaces, of the main reflector and/or the auxiliary reflectors to soften the illumination pattern generated on the secondary target area.

BRIEF DESCRIPTION OF THE DRAWINGS

Preferred features of the present invention will now be described by way of example only with reference to the accompanying drawings, in which.

DETAILED DESCRIPTION OF THE INVENTION

Figure 1:
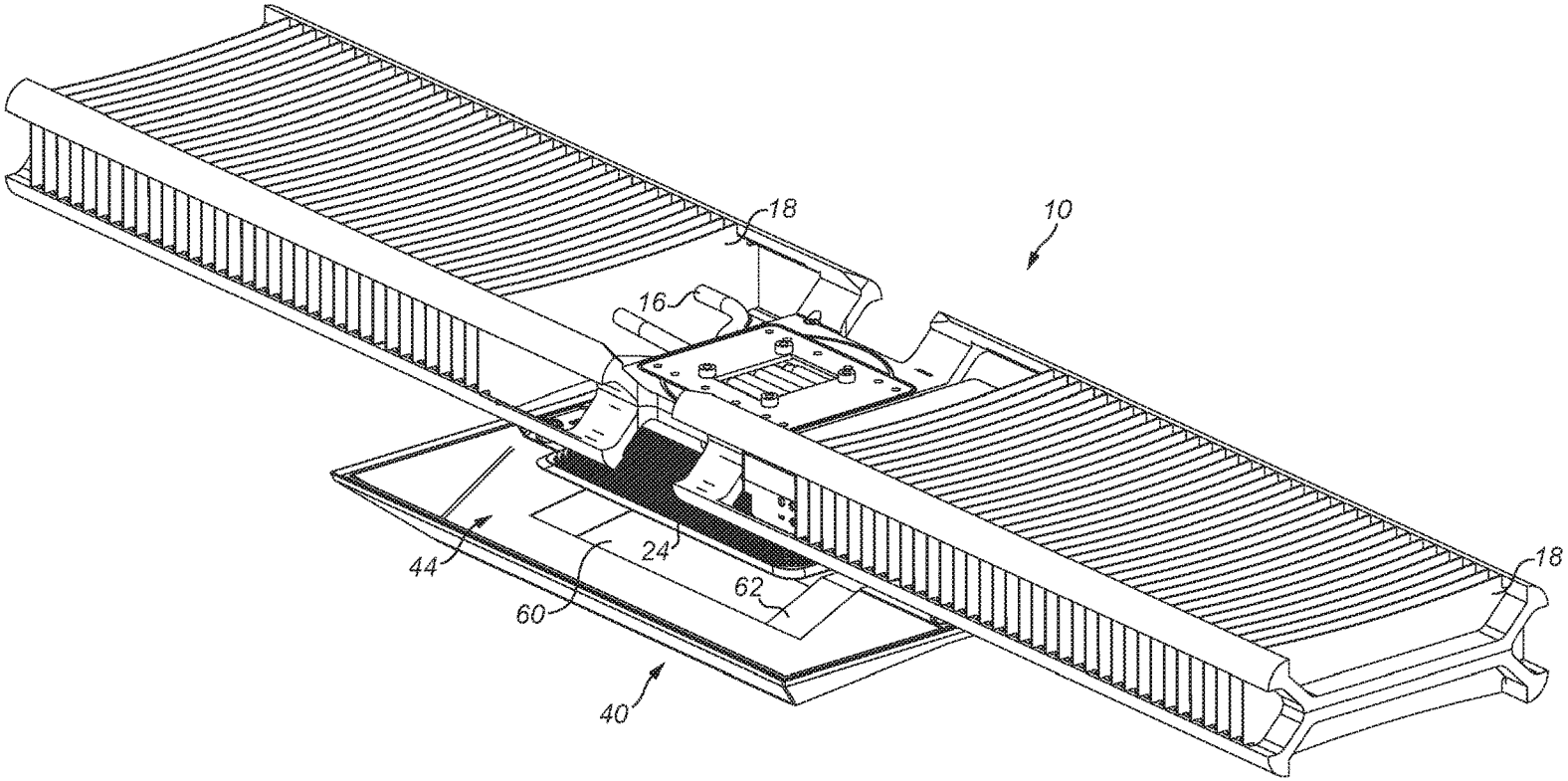
FIG. 1 is a perspective view, from above, of a lighting device.
Figure 2:
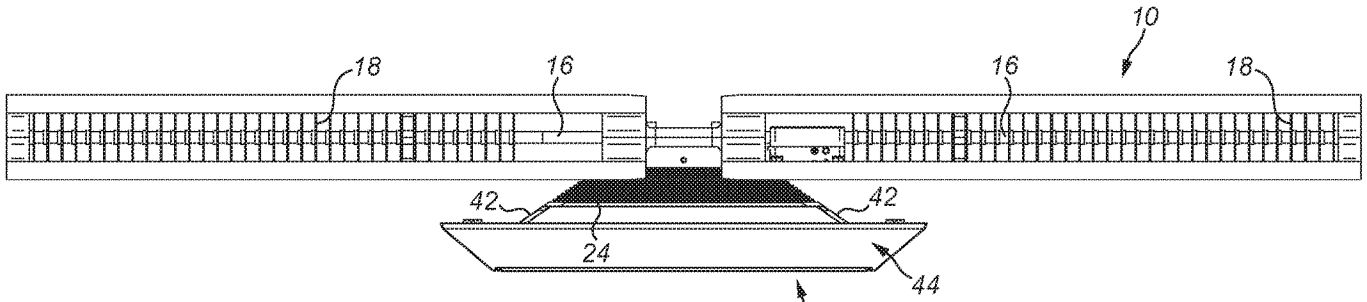
FIG. 2 is a side view of the lighting device.
Figure 3:
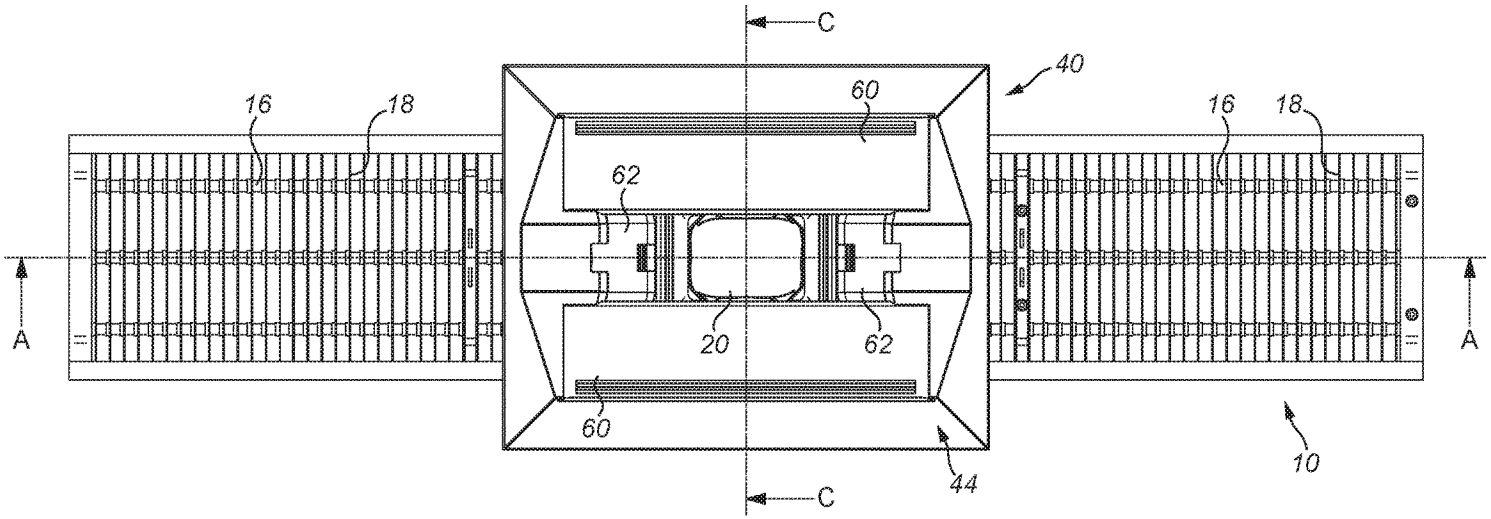
FIG. 3 is a bottom view of the lighting device.

FIGS. 1 to 3 are external views of a lighting device. In this embodiment, the lighting device is in the form of a suspended lighting device 10 which is suspended from the ceiling of a room, office, hall or other domestic or commercial environment to illuminate a target area, such as a desk, a bench or a meeting table. However, the lighting device may take other forms, such as floor- or desk-standing lamp, or a wall-mounted lighting device.

Figure 4A:
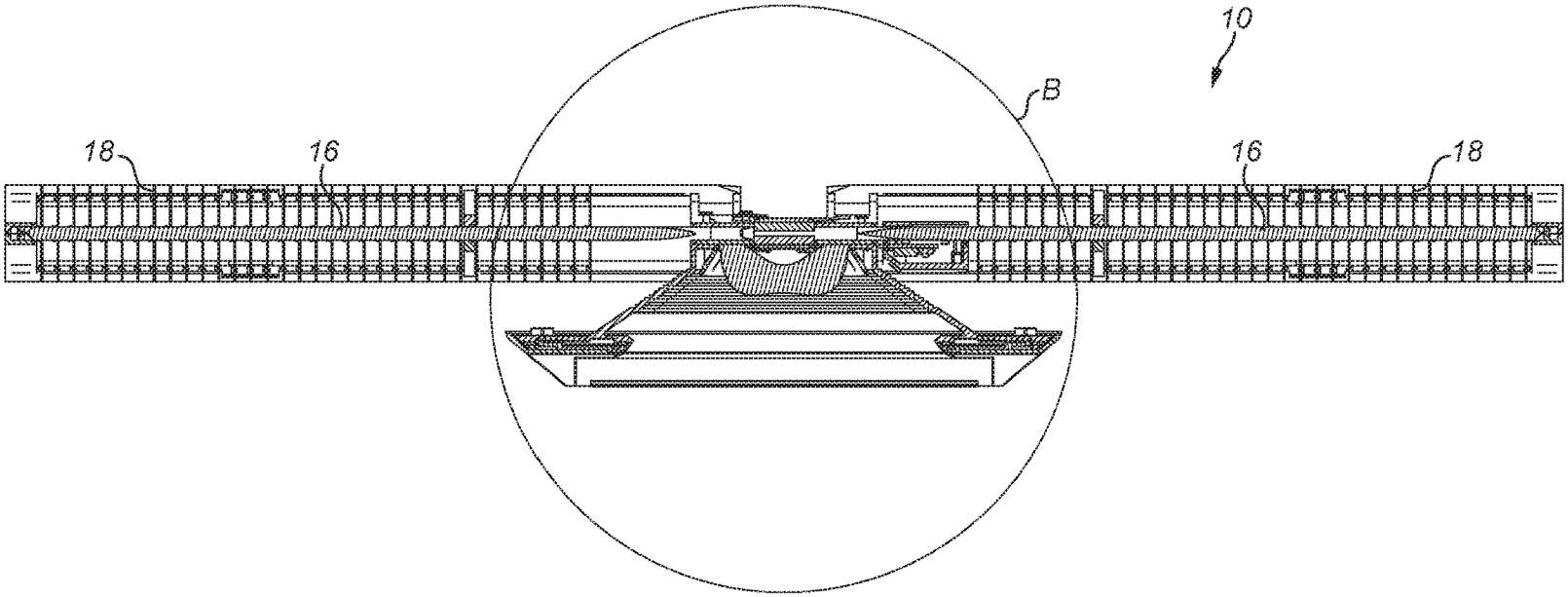
FIG. 4(*a*) is a front sectional view taken along line A-A in FIG. 3, FIG. 4(*b*) is a close-up of region B in FIG. 4(*a*), and FIG. 4(*c*) is a side sectional view taken along line C-C in FIG. 3.
Figure 4B:
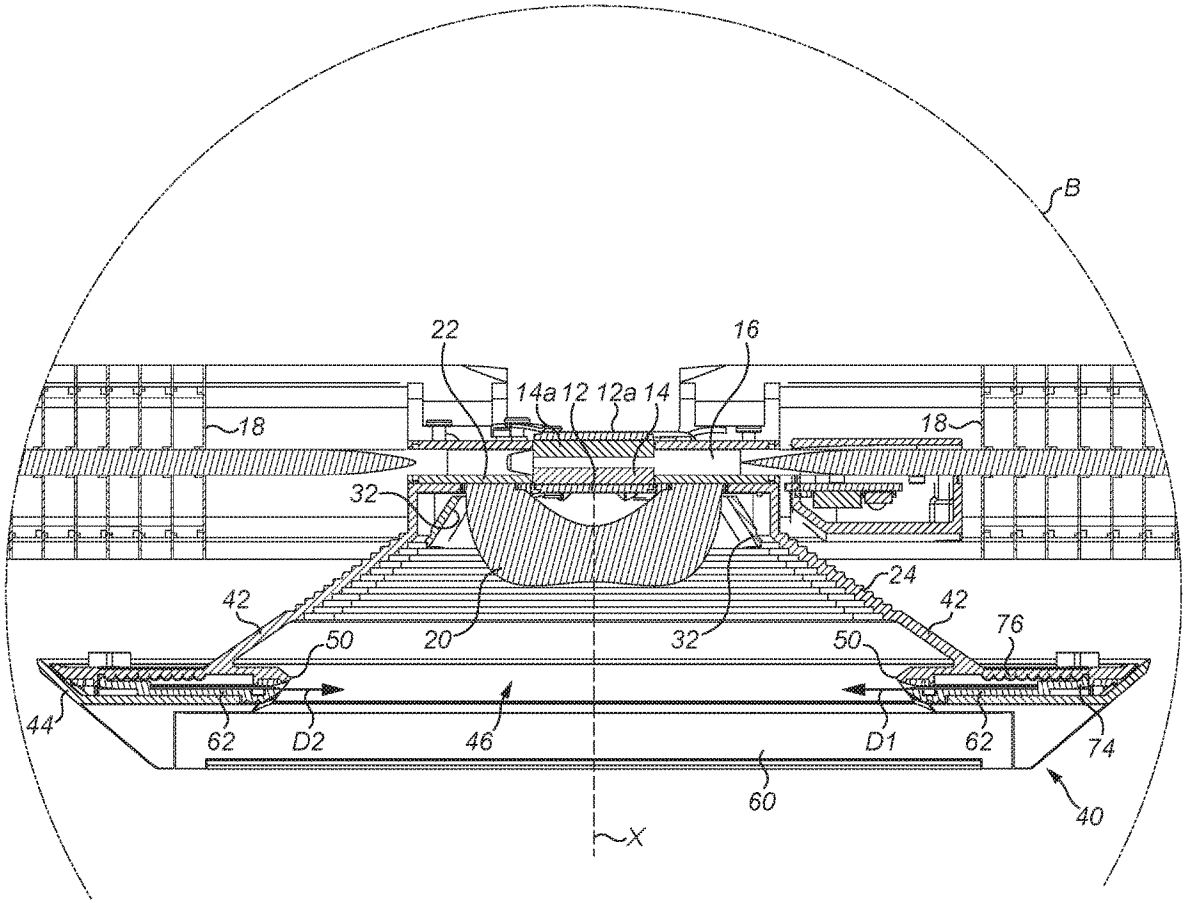
Figure 4C:
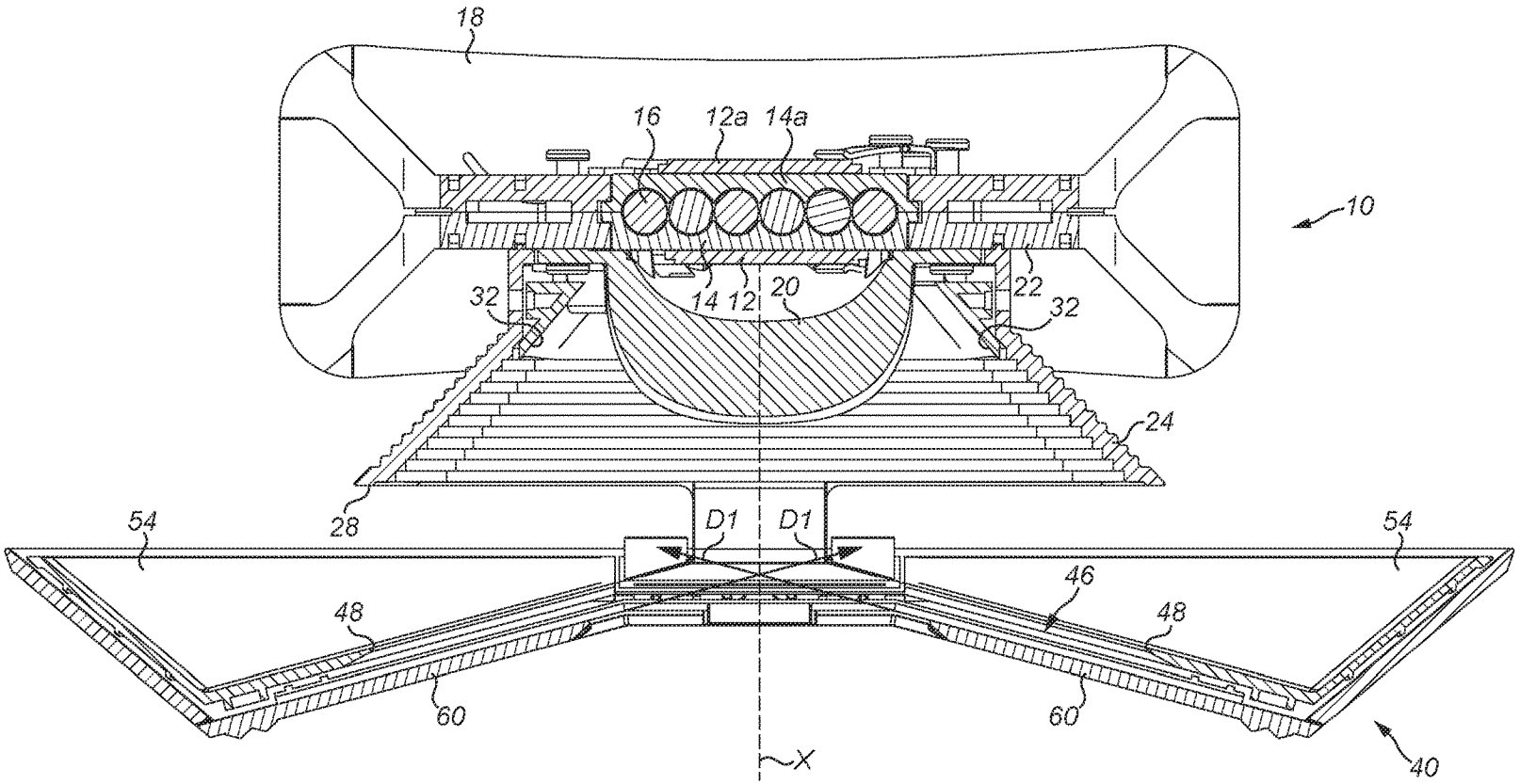
Figure 5A:
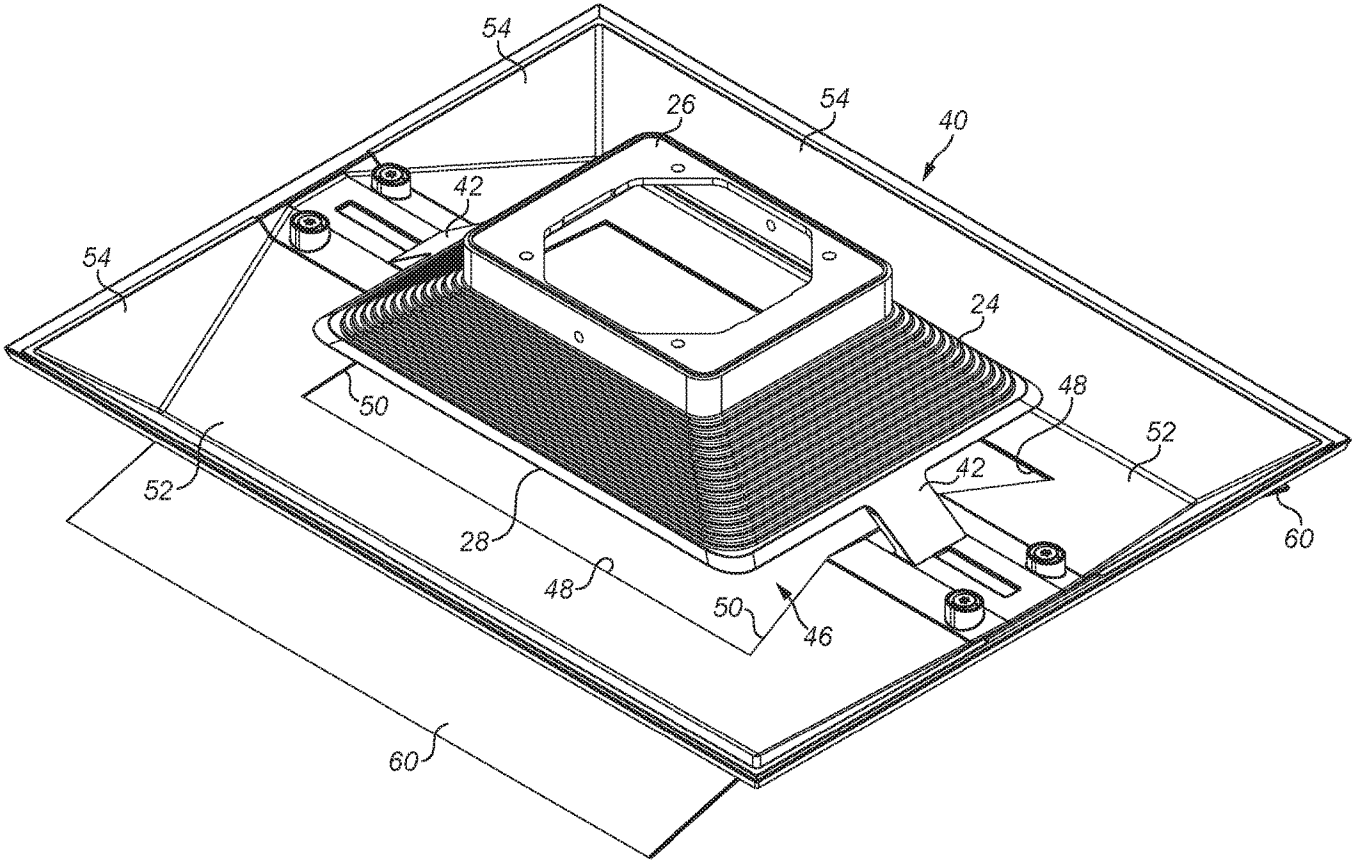
FIG. 5(*a*) is a perspective view, from above, of a baffle and a reflector module of the lighting device, with auxiliary reflectors of the reflector module in a stowed position, FIG. 5(*b*) is a top view of the baffle and the reflector module as shown in FIG. 5(*a*), FIG. 5(*c*) is a side sectional view taken along line A-A in FIG. 5(*b*), and FIG. 5(*d*) is a front sectional view taken along line B-B in FIG. 5(*b*)
Figure 5B:
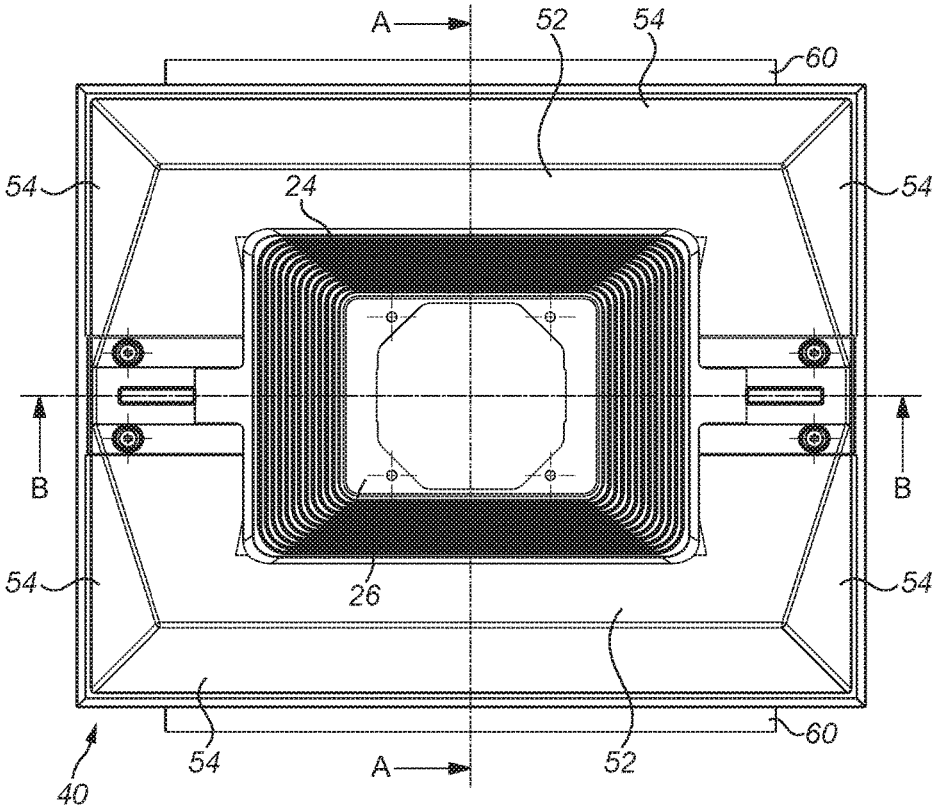
Figure 5C:
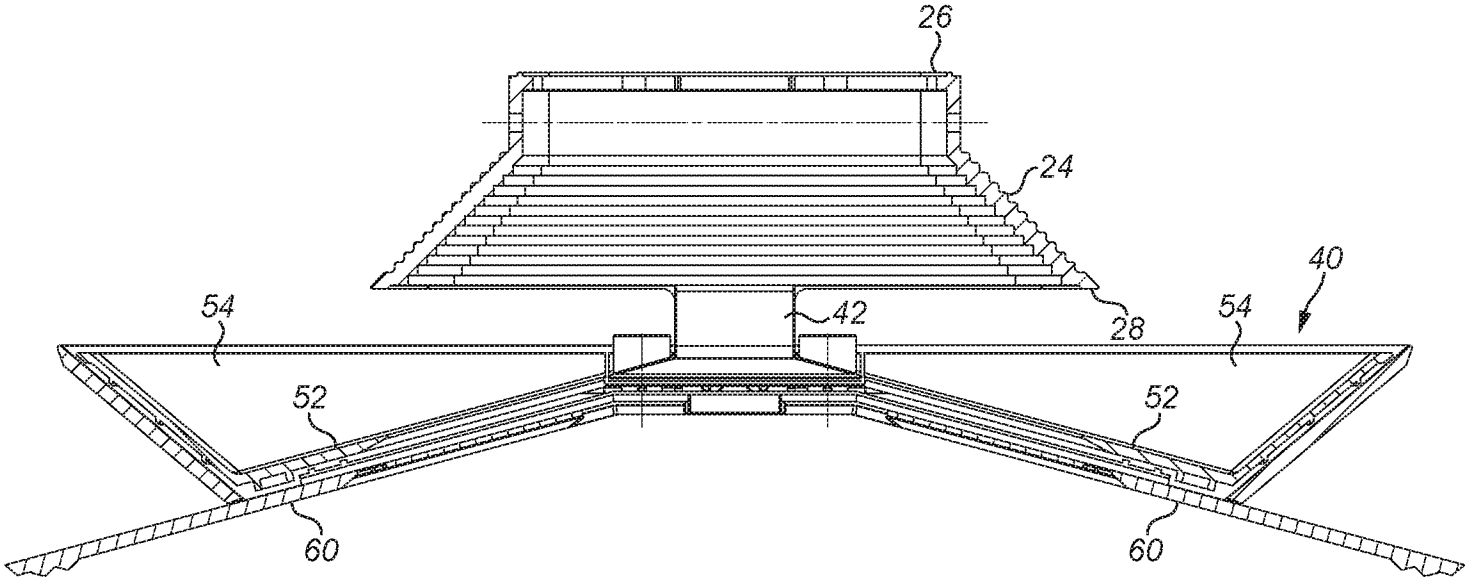
Figure 5D:
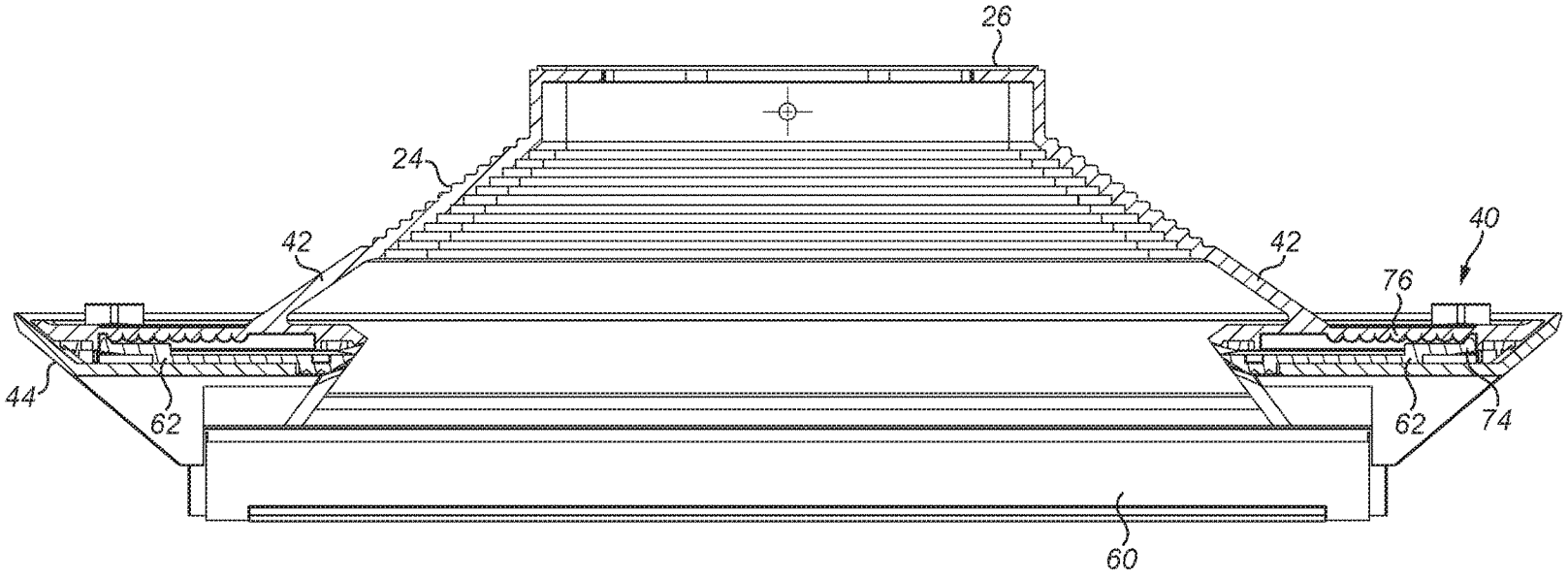
Figure 6A:
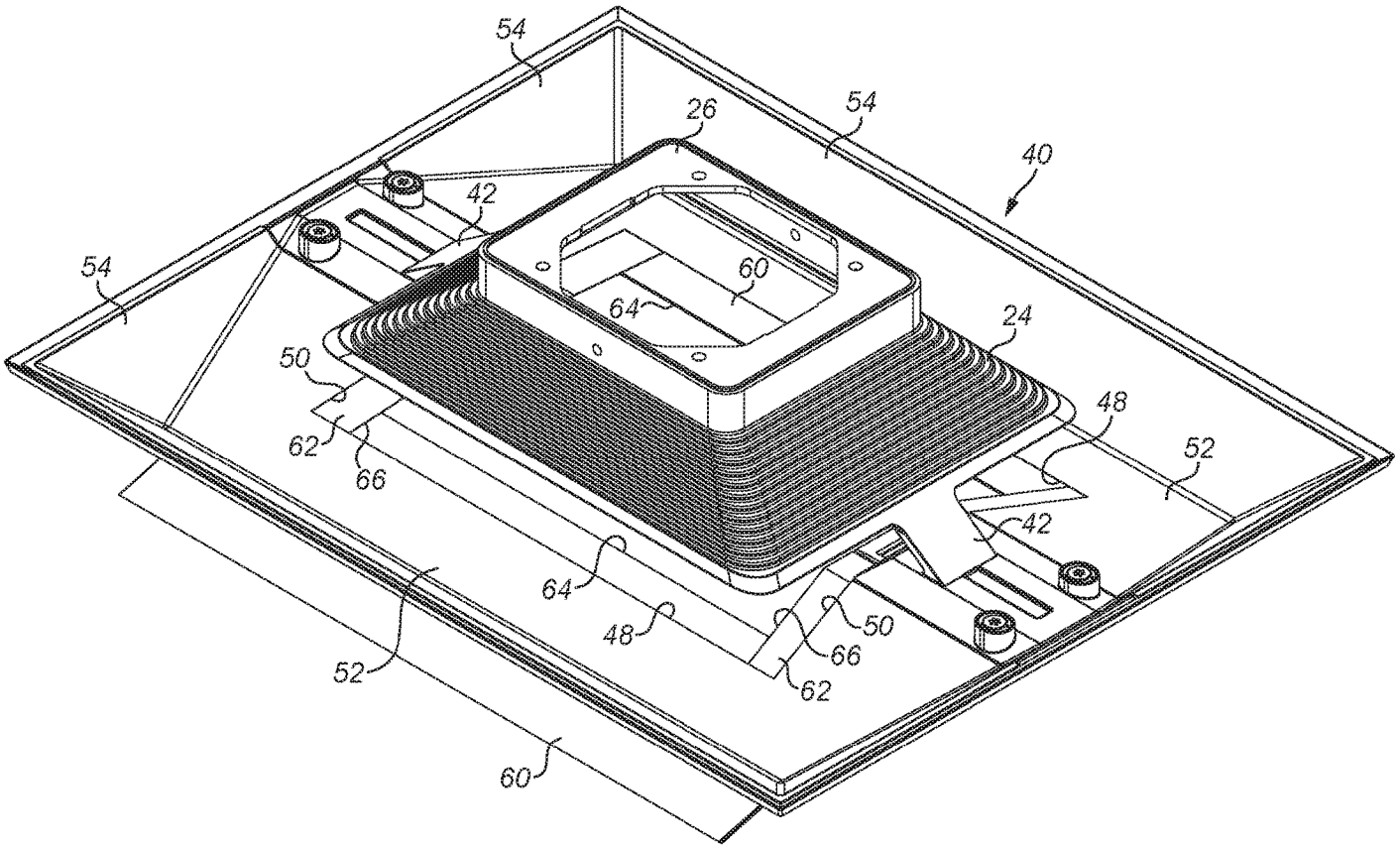
FIG. 6(*a*) is a perspective view, from above, of the baffle and the reflector module, but with the auxiliary reflectors in a first deployed position, FIG. 6(*b*) is a top view of the baffle and the reflector module as shown in FIG. 6(*a*), FIG. 6(*c*) is a side sectional view taken along line A-A in FIG. 6(*b*), and FIG. 6(*d*) is a front sectional view taken along line B-B in FIG. 6(*b*)
Figure 6B:
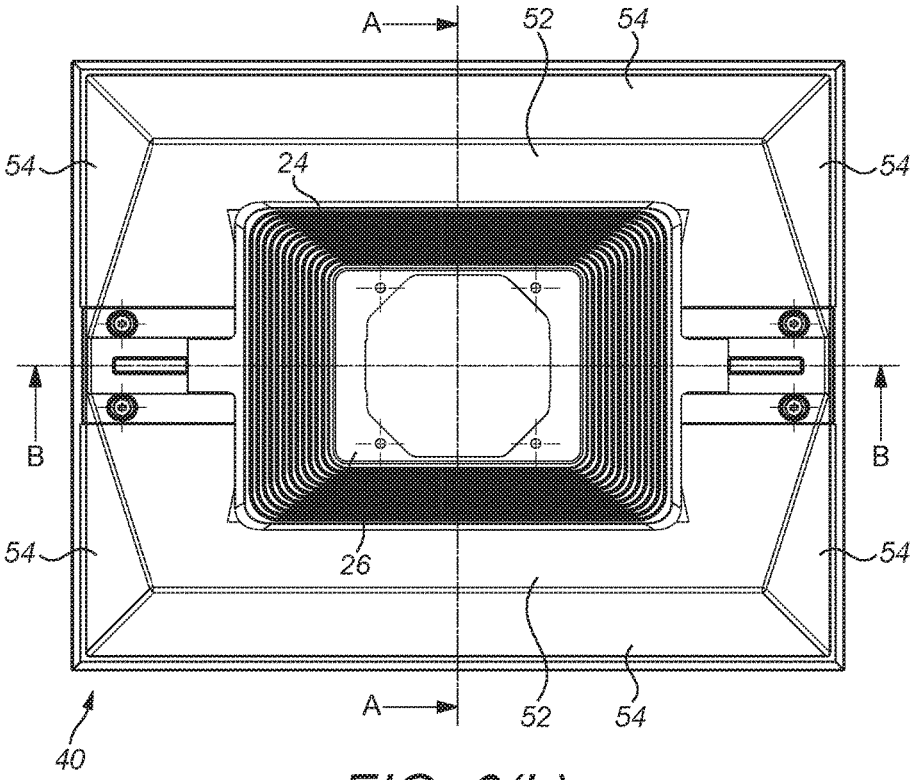
Figure 6C:
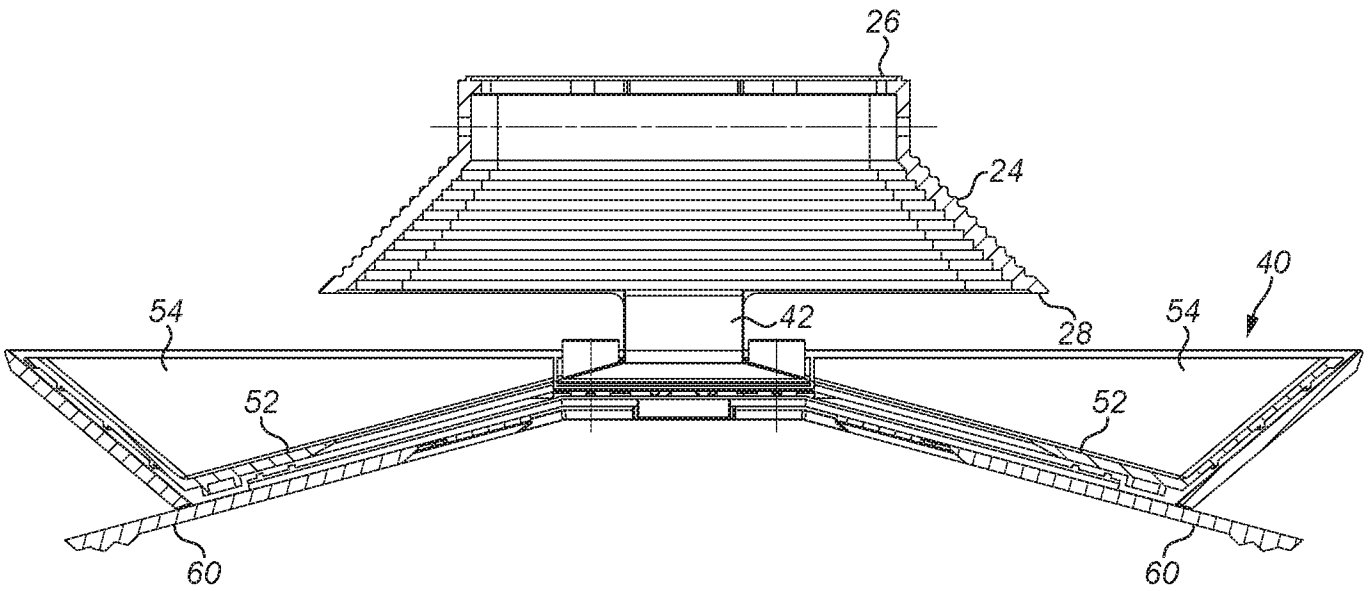
Figure 6D:
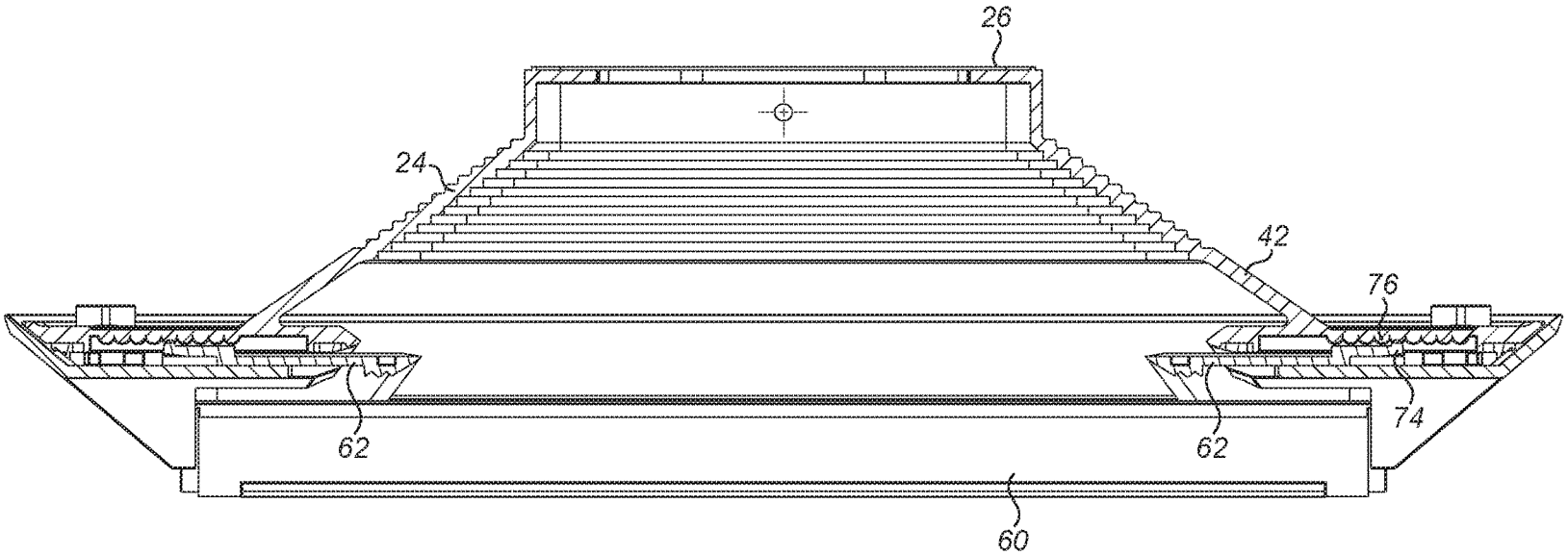
Figure 7A:
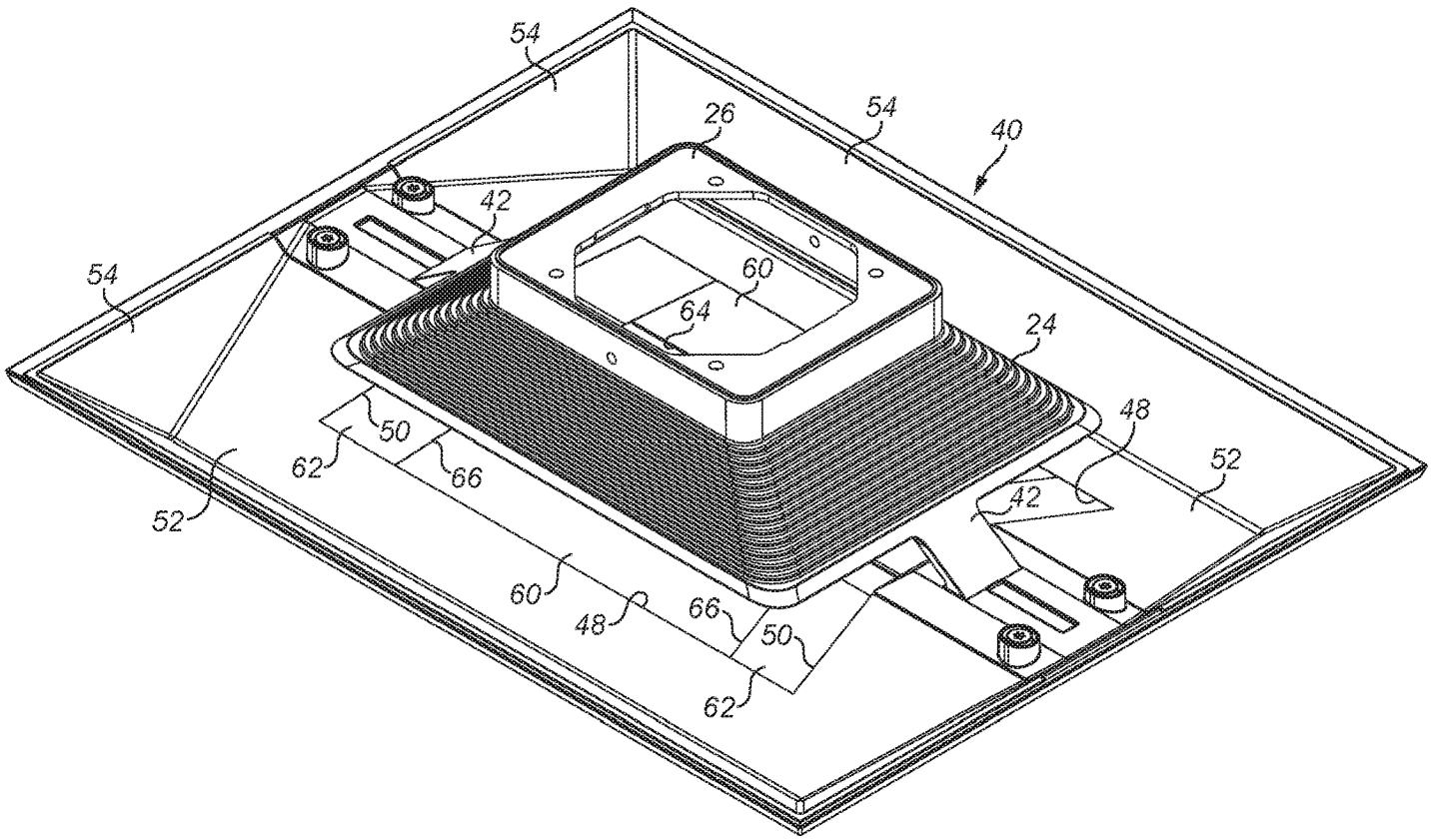
FIG. 7(*a*) is a perspective view, from above, of the baffle and the reflector module, but with the auxiliary reflectors in a second deployed position, FIG. 7(*b*) is a top view of the baffle and the reflector module as shown in FIG. 7(*a*), FIG. 7(*c*) is a side sectional view taken along line A-A in FIG. 7(*b*), and FIG. 7(*d*) is a front sectional view taken along line B-B in FIG. 7(*b*)
Figure 7B:
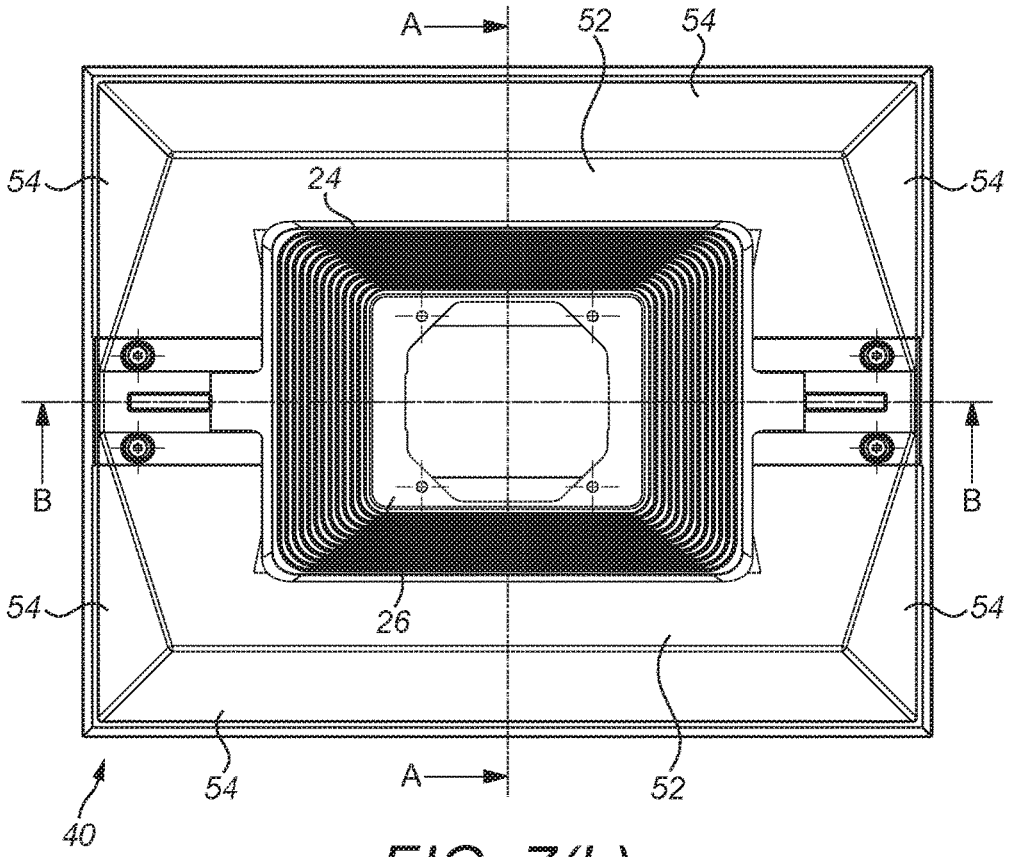
Figure 7C:
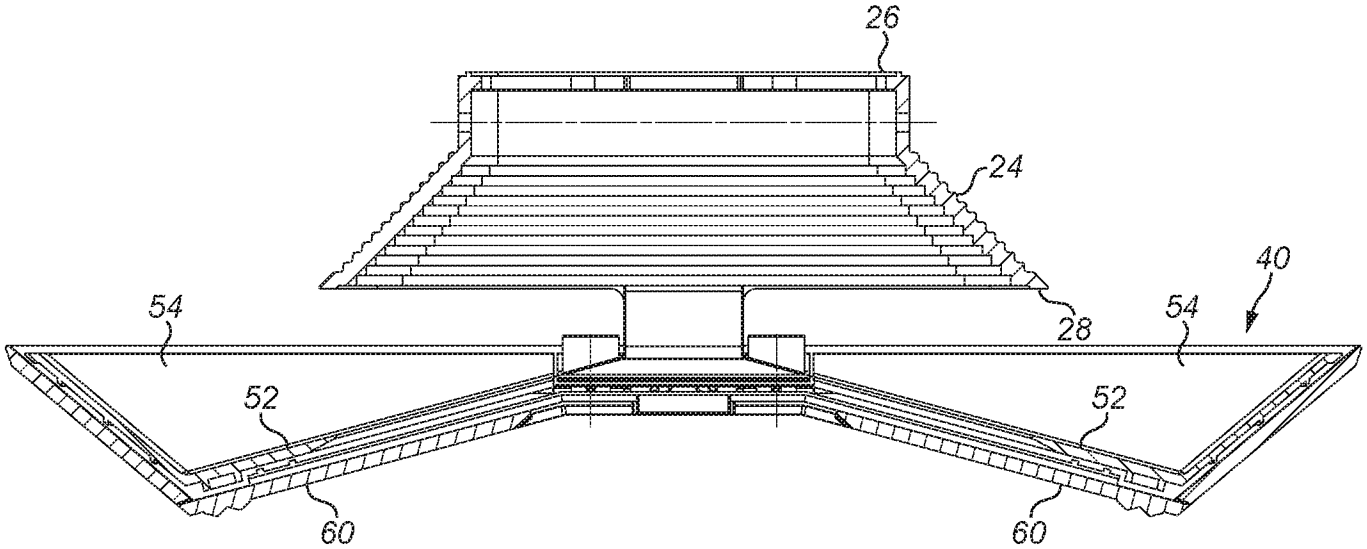
Figure 7D:
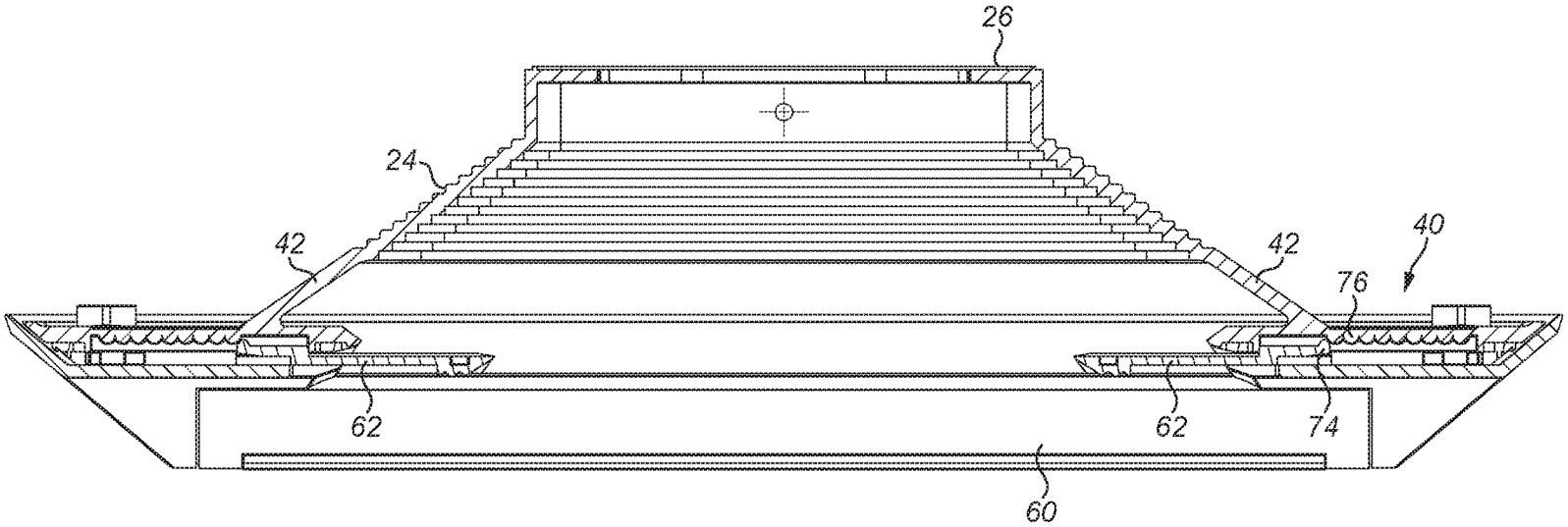

With reference also to FIGS. 4(*a*) to 4(*c*), the lighting device 10 comprises a light source 12 for generating visible light. In this embodiment, the light source 12 is a chip-on-board (COB) LED module which is mounted on a thermally conductive mounting plate 14. The mounting plate 14 is in thermal communication with a cooling circuit, which comprises a plurality of heat pipes 16 which engage the mounting plate 14, and a plurality of fins 18 which are connected to the heat pipes 16. Details of the cooling circuit are described in WO 2015/136241, the contents of which are incorporated herein by reference, and so will not be repeated here.

The lighting device 10 is suspended from the ceiling by suspension cables (not shown) which are physically connected to the heat pipes 16. Driving electronics for the lighting device 10 are located within a separate module (not shown) which may be mounted on, or recessed into, the ceiling, or housed within the ceiling void. These electronics are connected to the light source 12 by wires which are attached to, or form part of, the suspension cables.

The lighting device 10 comprises a lens 20 for creating a desired light distribution pattern from the light generated by the light source 12. In this embodiment, the lens 20 is shaped to create a light distribution pattern for illuminating a rectangular target area located beneath the lighting device 10. The lens 20 is mounted on a supporting plate 22 which extends about the mounting plate 14 for the light source 12, and which forms part of a support frame for supporting the cooling circuit. A baffle 24 surrounds both the light source 12 and the lens 20. With reference also to FIGS. 5(*a*) to 5(*d*), the baffle 24 is generally in the form of a truncated rectangular pyramid, which comprises a series of annular ridges located between a first, relatively small, open end 26 and a second, relatively large, open end 28. The first open end 26 is connected to the supporting plate 22 so that the baffle 24 is axially aligned with the optical axis X of the light source 12, as shown in FIGS. 4(*b*) and 4(*c*), with the open ends of the baffle 24 concentrically arranged on the optical axis X. The internal surface of the baffle 24 may be lined with, or formed from, reflective material so that any light emitted from the lens 20 which is incident thereon is reflected towards the second open end 28. Alternatively, or additionally, a curved or conical reflector 32 may be connected to the internal surface of the baffle 24, and disposed about the lens 20, for guiding light incident thereon towards the second open end 28 of the baffle 24.

The lighting device 10 further comprises a reflector module 40. The reflector module 40 is disposed relative to the baffle 24 so that reflective surfaces of the reflector module 40 are spaced from, and located optically downstream of, the baffle 24, and so in this embodiment the reflector module 40 is located beneath the baffle 24. The reflector module 40 is connected directly to the baffle 24 via struts 42 which extends between the second open end 28 of the baffle 24 and the reflector module 40. The reflector module 40 is preferably detachably connected to the struts 42 to allow the reflector module 40 to be removed from the lighting device 10, for example for cleaning or adjustment, as discussed in more detail below.

The reflector module 40 defines an aperture of variable size through which the light generated by the light source 12 is projected towards the target area. The reflector module 40 comprises a main reflector 44 and a plurality of auxiliary reflectors which are moveable relative to the main reflector 44 to adjust the size of the aperture of the reflector module 40. The main reflector 44 is connected to the baffle 24, and the auxiliary reflectors are connected to the main reflector 44. The auxiliary reflectors are moveable relative to the main reflector 44 between a stowed position and one of a number of deployed positions. When each of the auxiliary reflectors is in its stowed position, the aperture size of the reflector module 40 is at a maximum value, whereas when each of the auxiliary reflectors is in a fully deployed position, the aperture size of the reflector module 40 is at a minimum value.

The main reflector 44 comprises a light exit opening 46 from which the light output of the lighting device 10 is projected towards the target area. The main reflector 44 is shaped so that the light exit opening 46 is spaced along the optical axis X from the second open end 28 of the baffle 24, and so that the centre of the light exit opening 46 is located on the optical axis X.

As discussed below, when the auxiliary reflectors are in their stowed positions they are shielded from the light incident on the reflector module 40 by the main reflector 44. In this configuration of the reflector module 40, the periphery of the light exit opening 46 defines the maximum size of the aperture of the reflector module 40. The light which is incident on the reflector module 40 from the light source 12 is cropped by the main reflector 44 to generate the desired illumination pattern on the target area. In this embodiment, the illumination pattern is substantially rectangular, and so the edges of the light exit opening 46 are shaped to define the shape of the overall light beam which passes through the reflector module 40 to generate such an illumination pattern. The light exit opening 46 comprises a pair of relatively long edges 48 and a pair of relatively short edges 50. The long edges 48 are substantially parallel to one another, whereas the short edges 50 are non-parallel, having mutually inclined sections.

The upper surfaces of the main reflector 44 comprise reflective surfaces 52 located adjacent to the light exit opening 46. These reflective surfaces 52 define the edges of the light exit opening 46, and are arranged to reflect light incident thereon away from the target area located beneath the lighting device 10 and towards a secondary target area, such as a ceiling upon which the lighting device 10 is mounted, for indirect, or secondary, illumination of the local environment of the lighting device 10. These reflective surfaces 52 are arranged in a non-coplanar, non-parallel arrangement, in this embodiment such that each reflective surface 52 faces away from the optical axis X to ensure that any reflected light is not incident upon, and so is not absorbed by, other components of the lighting device 10, but is instead reflected away from the optical axis and towards the secondary target area.

Each reflective surface 52 of the main reflector 44 may take any shape for creating a desired illumination pattern on the secondary target area, and so may be a curved, a faceted or a planar reflector, or may comprise a combination of different shapes. In the preferred embodiment, each reflective surface 52 of the main reflector 44 is a planar reflective surface, which is inclined at an angle in the range from 5 to 30° relative to a plane which is normal to the optical axis X of the light exit opening 46. In this example, each reflective surface 52 of the main reflector 44 is inclined at an angle of approximately 15° to that plane.

The main reflector 44 also comprises a plurality of peripheral walls 54 which are arranged about, and angled relative to, the reflective surfaces 52. The peripheral walls 54 serve to shield the reflective surfaces 52 of the main reflector 44 from a normal field of view of the lighting device 10. Each of the peripheral walls 54 preferably comprises reflective surfaces which face towards the optical axis to direct light, which is reflected thereon by one of the other reflective surfaces of the reflector module 40, towards the secondary target area.

As mentioned above, the reflector module 40 comprises a plurality of auxiliary reflectors which are connected to, and moveable relative to, the main reflector 44 to adjust the size of the aperture of the reflector module 40, and so adjust the size of the light output of the lighting device 10. The upper surfaces of the auxiliary reflectors also comprise reflective surfaces. Each reflective surface of the auxiliary reflectors may take any shape for creating a desired illumination pattern on the secondary target area, and so may be a curved, a faceted or a planar reflector, or may comprise a combination of different shapes.

In the preferred embodiment, each reflective surface of the auxiliary reflectors is a planar reflective surface.

In this embodiment, each auxiliary reflector is slidable manually relative to the main reflector 44 along slots or grooves of the main reflector 44, which slots or grooves also serve to retain the auxiliary reflectors on the main reflector 44. The main reflector 44 comprises upper and lower body sections which are connected together during assembly of the reflector module 40, and between which one or more portions of each auxiliary reflector are retained.

Each of the auxiliary reflectors is moveable relative to the main reflector 44 between a stowed position and one of a number of deployed positions. FIGS. 5(*a*) to 5(*d*) illustrate the configuration of the reflector module 40 when each of the auxiliary reflectors is in its stowed position. In this position, each of the auxiliary reflectors is located directly beneath the main reflector 44 so that it is shielded by the main reflector 44 from the light generated by the light source 12. In this embodiment, the reflector module 40 comprises a pair of first auxiliary reflectors 60 and a pair of second auxiliary reflectors 62. The first auxiliary reflectors 60 are disposed on first opposite sides of the light exit opening 46, and the second auxiliary reflectors 62 are disposed on second opposite sides of the light exit opening 46, and so the first auxiliary reflectors 60 and the second auxiliary reflectors 62 are disposed alternately about the optical axis X.

In its stowed position, each of the first auxiliary reflectors 60 lies directly beneath, and parallel to, a respective one of the reflective surfaces 52 of the main reflector 44. Each of the first auxiliary reflectors 60 comprises a single planar reflective surface, which extends along the length of one of the relatively long edges 48 of the light exit opening 46, and has a leading edge 64 which is substantially parallel with that long edge 48 of the light exit opening 46. Similar to the reflective surfaces 52 of the main reflector 44, the reflective surface of each of the first auxiliary reflectors 60 is thus inclined at an angle of 15° relative to a plane which is normal to the optical axis X of the light exit opening 46.

In contrast, in its stowed position each of the second auxiliary reflectors 62 lies directly beneath respective portions of both reflective surfaces 52 of the main reflector 44. Thus, each second auxiliary reflector 62 comprises (i) a first portion which, in the stowed position, lies directly beneath one of the reflective surfaces 52, and preferably between that reflective surface 52 and one of the first auxiliary reflectors 60, and (ii) a second portion which, in the stowed position, lies directly beneath the other reflective surface 52, and preferably between that reflective surface 52 and the other first auxiliary reflector 60.

Each portion of the second auxiliary reflector 62 comprises a respective reflective surface. Thus, the reflective surfaces of each of the second auxiliary reflectors 62 are also inclined relative to a plane which is normal to the optical axis of the light exit opening, but in this case the reflective surfaces of a second auxiliary reflectors 62 are mutually relatively inclined. Each of the second auxiliary reflectors 62 has a leading edge 66 which has the same shape as the relatively short edge 50 of the light exit opening 46.

Each of the auxiliary reflectors is moveable relative to the main reflector 44 from the stowed position to one of a number of deployed positions. FIGS. 6(*a*) to 6(*d*) illustrate the configuration of the reflector module 40 when the auxiliary reflectors are in a first deployed position, which is midway between the stowed position and a second, fully deployed position, and FIGS. 7(*a*) to 7(*d*) illustrate the configuration of the reflector module 40 when the auxiliary reflectors are in the fully deployed position. The auxiliary reflectors may be moveable individually, in pairs or simultaneously relative to the main reflector 44.

Each auxiliary reflector is moveable relative to the main reflector 44 along a respective path, which in this embodiment is a linear path. Each of these paths is angled relative to the optical axis X. The first auxiliary reflectors 60 are moveable along a path which extends in a direction D1—indicated in FIG. 4(*c*)—which is inclined relative to the optical axis X by an angle of 105°, so that the reflective surface of each first auxiliary reflector 60 remains substantially parallel to its respective reflective surface 52 of the main reflector 44 as it moves between its stowed and fully deployed positions. The second auxiliary reflectors 62 are moveable along a path which extends in a direction D2—indicated in FIG. 4(*b*)—which is substantially orthogonal to the optical axis X so that each reflective surface of each second auxiliary reflector 62 remains substantially parallel to its respective reflective surface 52 of the main reflector 44 as it moves between its stowed and fully deployed positions.

Each pair of auxiliary reflectors approach one another as those auxiliary reflectors are moved away from their stowed positions. As an auxiliary reflector moves away from its stowed position, it moves across the light exit opening 46 of the main reflector 44 to reduce the aperture area of the reflector module 40, and thereby crop the light output projected towards the target area. Simultaneously with the reduction of the aperture area of the reflector module 40, the amount of light which is reflected away from the target area increases, through the exposure of the reflective surface of the auxiliary reflector to the generated light. In other words, the cropped light is not absorbed by the lighting device 10, but is instead also reflected towards the secondary target area where it can contribute to the overall illumination of the environment in which the lighting device 10 is located. The movement of the auxiliary reflector towards its fully deployed position thus gradually increases the size and/or intensity of the illumination pattern generated on the secondary target area.

Figure 8A:
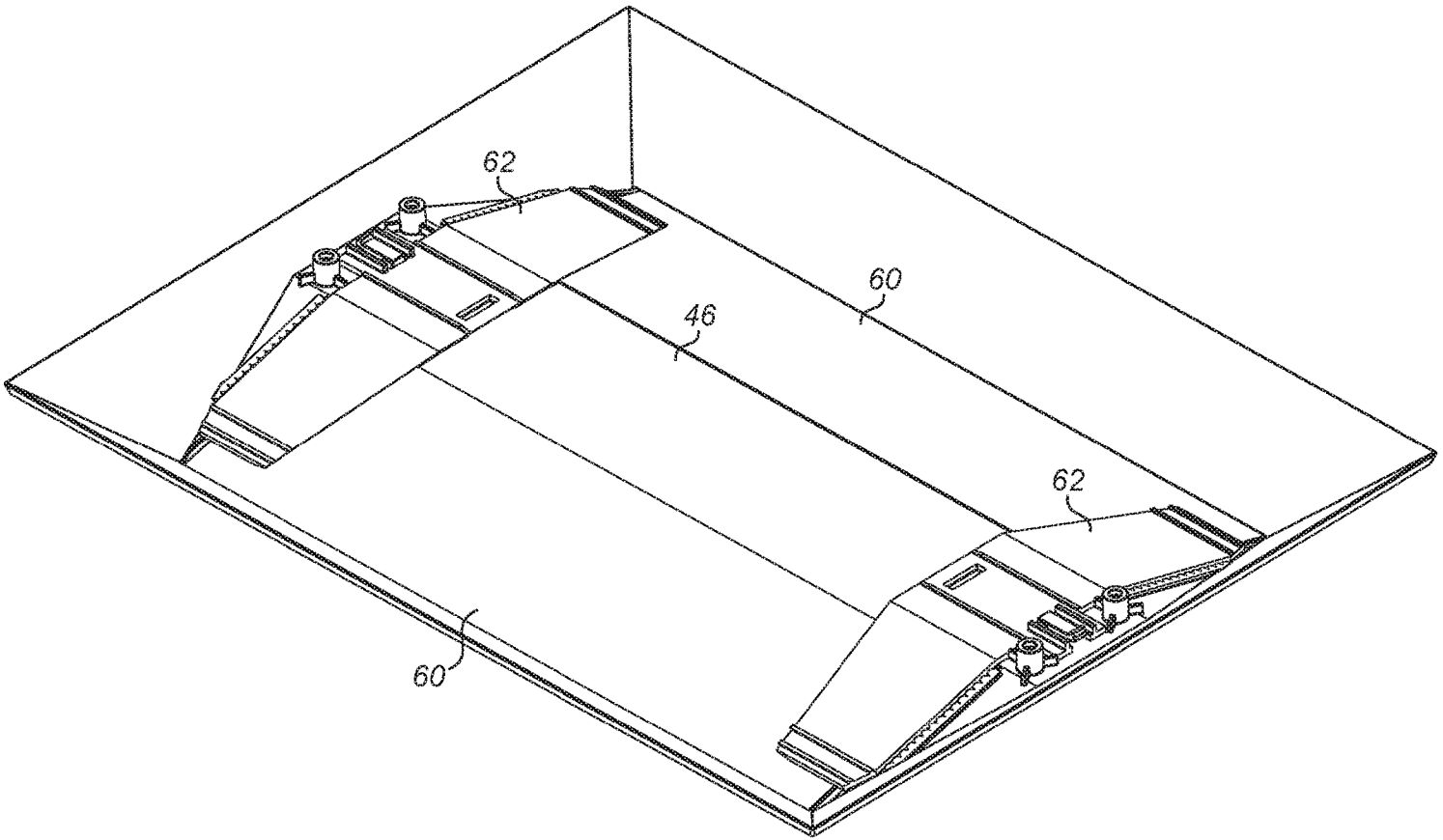
FIG. 8(*a*) is a perspective view, from above, of part of the reflector module, and FIG. 8(*b*) is a similar view to FIG. 8(*a*) but with a pair of second auxiliary reflectors removed.
Figure 8B:
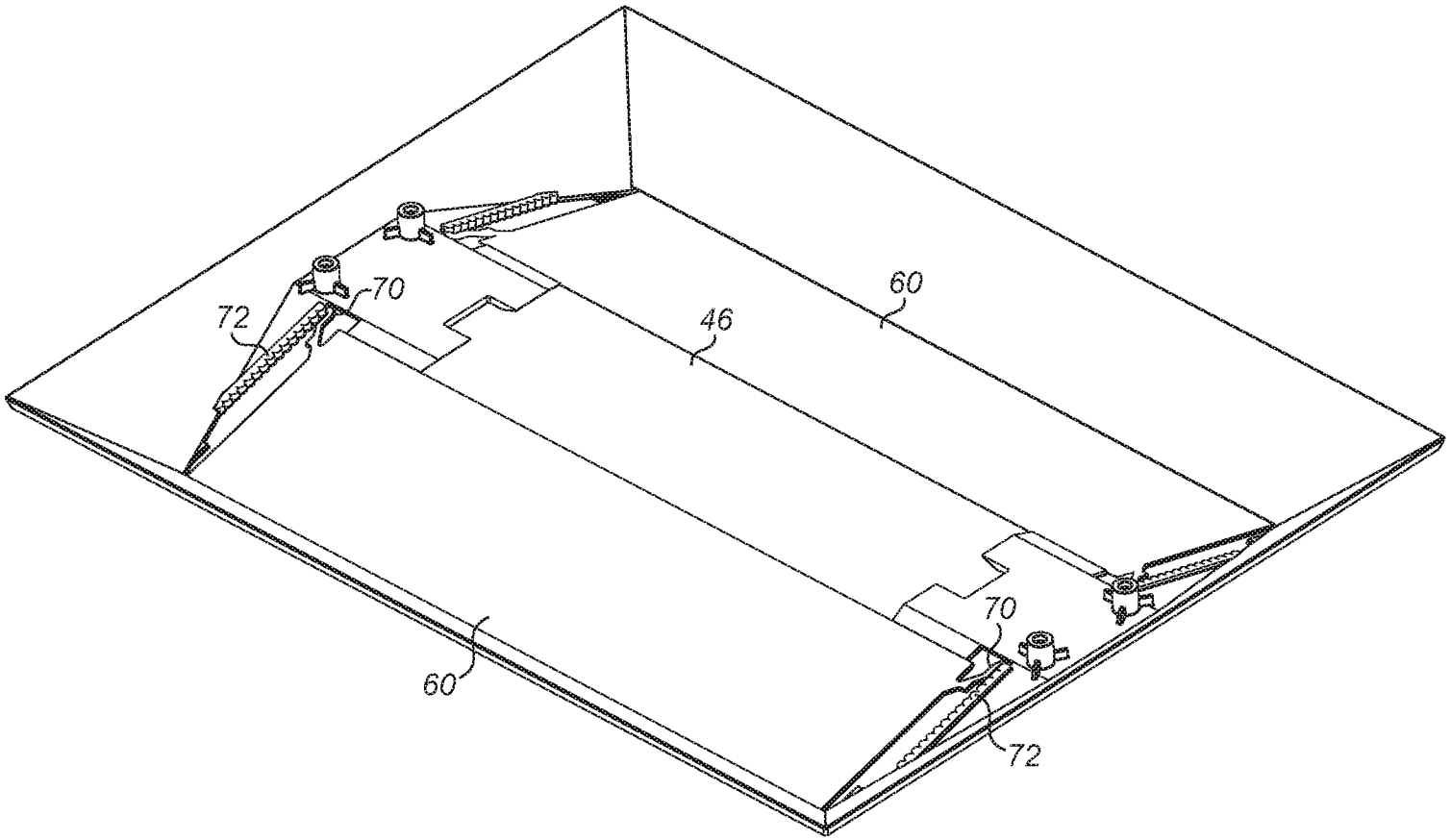

Each auxiliary reflector is preferably moveable relative to the main reflector 44 from the stowed position to one of a number of deployed positions, in each of which the reflective surface of the auxiliary reflector is exposed by a respective different amount to the light generated by the light source 12. With reference to FIGS. 8(*a*) to 8(*b*), in this embodiment each of the first auxiliary reflectors 60 comprises a detent member 70 on each side thereof, and the main reflector 44 comprises two series of detent recesses 72 each for engaging with a respective detent member 70 at a respective one of the deployed positions to check the motion of the first auxiliary reflector 60 relative to the main reflector 44. Similarly, with reference to FIGS. 5(*d*), 6(*d*) and 7(*d*), in this embodiment each of the second auxiliary reflectors 62 comprises a centrally positioned detent member 74, and the main reflector 44 comprises a series of detent recesses 76 each for engaging with the detent member 74 at a respective one of the deployed positions to check the motion of the second auxiliary reflector 62 relative to the main reflector 44. A catch or locking mechanism may be provided for securing an auxiliary reflector in a desired position.

As shown solely in FIGS. 4(*a*) to 4(*c*), an additional light source 12*a* may be provided for illuminating the secondary target area. This additional light source 12*a* may be mounted on an additional thermally conductive mounting plate 14*a* disposed on the opposite side of the heat pipes 16 to the mounting plate 14, which allows the cooling circuit to dissipate heat generated during use of both of the light sources.

The invention claimed is:

1. A lighting device comprising:

a light source disposed on an optical axis;

a baffle extending about the optical axis and surrounding the light source; and a reflector module connected to the baffle, the reflector module comprising:

a main reflector having a light exit opening from which a light output of the lighting device is projected towards a target area, the optical axis passing through the opening, and a plurality of reflective surfaces adjacent to the opening for reflecting light incident thereon away from the opening and at an angle to the optical axis; and a plurality of auxiliary reflectors for adjusting the shape of the light output of the lighting device, each auxiliary reflector comprising a reflective surface, each auxiliary reflector being moveable relative to the main reflector between a stowed position and a deployed position in which at least part of the reflective surface of the auxiliary reflector is exposed, by the opening of the main reflector, to reflect light incident thereon away from the target area.

2. The lighting device of claim 1, wherein each auxiliary reflector is slidable relative to the main reflector.

3. The lighting device of claim 1, wherein each auxiliary reflector is moveable relative to the main reflector along a linear path.

4. The lighting device of claim 3, wherein each linear path is angled to the optical axis.

5. The lighting device of claim 1, wherein each auxiliary reflector is, when in its stowed position, shielded by the main reflector from the light generated by the light source.

6. The lighting device of claim 1, wherein each of the auxiliary reflectors is moveable independently relative to the main reflector.

7. The lighting device of claim 1, wherein said at least part of the reflective surface of the auxiliary reflector is, when in the deployed position, parallel to an adjoining reflective surface of the main reflector.

8. The lighting device of claim 1, wherein the plurality of auxiliary reflectors comprises a pair of first auxiliary reflectors which approach one another with movement thereof towards their deployed positions, and a pair of second auxiliary reflectors which approach one another with movement thereof towards their deployed positions, the first auxiliary reflectors and the second auxiliary reflectors being disposed alternately about the optical axis.

9. The lighting device of claim 8, wherein the first auxiliary reflectors have a shape which is different from that of the second auxiliary reflectors.

10. The lighting device of claim 8, wherein each of the first auxiliary reflectors comprises a planar reflective surface.

11. The lighting device of claim 10, wherein the reflective surfaces of the first auxiliary reflectors are non-coplanar.

12. The lighting device of claim 8, wherein the reflective surface of each of the first auxiliary reflectors is inclined relative to a plane which is normal to the optical axis of the opening.

13. The lighting device of claim 12, wherein the reflective surface of each of the first auxiliary reflectors is inclined relative to said plane at an angle in the range from 5 to 30°.

14. The lighting device of claim 8, wherein each of the second auxiliary reflectors comprises a plurality of non-coplanar reflective surfaces.

15. The lighting device of claim 14, wherein the reflective surfaces of each of the second auxiliary reflectors are inclined relative to a plane which is normal to the optical axis of the opening.

16. The lighting device of claim 14, wherein each reflective surface of the second auxiliary reflectors is parallel to a reflective surface of an adjacent first auxiliary reflector.

17. The lighting device of claim 8, wherein, when the auxiliary reflectors are in their deployed positions, at least a portion of each of the second auxiliary reflectors is disposed between the main reflector and one of the first auxiliary reflectors.

18. The lighting device of claim 17, wherein a first portion of each of the second auxiliary reflectors is disposed between the main reflector and a first one of the first auxiliary reflectors, and a second portion of each of the second auxiliary reflectors is disposed between the main reflector and a second one of the first auxiliary reflectors.

19. The lighting device of claim 8, wherein each of the first auxiliary reflectors is moveable relative to the main reflector in a direction which intersects the optical axis at a first angle, and each of the second auxiliary reflectors is moveable relative to the main reflector in a direction which intersects the optical axis at a second angle, and wherein the first angle is different from the second angle.

20. The lighting device of claim 19, wherein the second angle is 90°.

21. The lighting device of claim 1, wherein the baffle comprises a first end proximate to the light source, and a second end remote from the light source, and wherein the main reflector is connected to the second end of the baffle.

22. The lighting device of claim 1, wherein each of the reflective surfaces of the main reflector which are adjacent to the opening is a planar reflector which faces away from the optical axis.

23. The lighting device of claim 1, wherein the main reflector comprises a plurality of peripheral surfaces arranged about, and angled relative to, the reflective surfaces adjacent to the opening.

24. The lighting device of claim 23, wherein each of the peripheral surfaces faces towards the optical axis.

25. The lighting device of claim 23, wherein each of the peripheral surfaces comprises a reflective surface.

* * * * *